US005273089A

United States Patent [19]

Fuchs et al.

[11] Patent Number: 5,273,089

[45] Date of Patent: Dec. 28, 1993

[54] ROUTING MACHINE

[75] Inventors: Rudolf Fuchs, Neuhausen; Cornelius Boeck, Leinf.-Echterdingen, both of Fed. Rep. of Germany; Bruce Roberts; David M. Martinez, both of New Bern, N.C.

[73] Assignee: Robert Bosch GmbH, Stuttgart, Fed. Rep. of Germany

[21] Appl. No.: 974,803

[22] Filed: Nov. 12, 1992

[30] Foreign Application Priority Data

Dec. 3, 1991 [DE] Fed. Rep. of Germany ..... 4139759

[51] Int. Cl.[5] ..... B27C 5/00

[52] U.S. Cl. ..... 144/134 D; 144/136 C; 409/182

[58] Field of Search ..... 144/134 R, 134 D, 136 R, 144/136 C, 371; 409/178, 182

[56] References Cited

U.S. PATENT DOCUMENTS

| | | | |
|---|---|---|---|
| 3,487,747 | 1/1970 | Burrows et al. | 409/182 |
| 4,102,370 | 7/1978 | Vess | 409/182 |
| 4,445,811 | 5/1984 | Sanders | 409/184 |
| 4,461,330 | 7/1984 | Judkins | 409/182 |
| 4,770,573 | 9/1988 | Monobe | 409/184 |
| 4,938,264 | 7/1990 | Ferenczffy | 409/182 |
| 5,143,494 | 9/1992 | McCurry | 409/182 |

*Primary Examiner*—W. Donald Bray
*Attorney, Agent, or Firm*—Michael J. Striker

[57] ABSTRACT

A routing machine has a motor housing with a lower side having a tool receptacle for a milling tool, a foot plate adapted to be placed on a workpiece, guiding columns extending perpendicularly relative to the foot plate, the motor housing being arranged displaceably on the guiding columns parallel to an axis of the milling tool, a clamping sleeve having a clamping screw and releasably fixing the motor housing on at least one of the guiding columns, at least one spring supporting the motor housing on the foot plate, an adjusting member axially displaceable relative to the clamping sleeve over a thread and supports a weight of the motor housing. The spring has an upper end abutting against the adjusting member. The motor housing is supported relative to the adjusting member on bearings and is fixed in an axial direction of the guiding column at both sides.

15 Claims, 3 Drawing Sheets

ROUTING MACHINE

BACKGROUND OF THE INVENTION

The present invention relates to a routing machine.

More particularly, it relates to a routing machine which has a motor housing with a tool receptacle for a milling tool at its lower side and movable on guiding columns extending vertically and with a foot plate adapted to be placed on a workpiece and displaceable parallel to the axis of the tool and also releasably fixable with at least one guiding column, with a spring abutting against the foot plate and against a clamping sleeve which fixes the motor housing.

Routing machines of the above mentioned general type are known in the art. One of such routing machines is disclosed in U.S. Pat. No. 4,938,264. This reference discloses a routing machine which is provided with milling depth adjustment. The individual parts of the milling depth adjustment device are however such that they can be produced by expensive manufacturing processes, and also for the fine adjustment a great force must be applied.

SUMMARY OF THE INVENTION

Accordingly, it is an object of the present invention to provide a routing machine which avoids the disadvantages of the prior art.

In keeping with these objects and with others which will become apparent hereinafter, one feature of the present invention resides, briefly stated, in a routing machine of the above mentioned type in which the motor housing is supported relative to the adjusting member on bearings and is fixed in the axial direction of the guiding column at both sides.

When the routing machine is designed in accordance with the present invention, for fine adjustment of the milling depth only a low force is required. Furthermore, it has the advantage that the fine adjustment is performed in a play-free manner, and by the force application on the handle no changes of the milling depth can occur.

In accordance with another embodiment of the present invention it is especially advantageous when the motor housing is guided directly on the guiding columns of the foot plate. Thereby the play between the guiding columns and the motor housing can be retained optimally low.

It is especially advantageous when the motor housing is formed as an aluminum pressure casting part. As for the adjusting member it is advantageously composed of synthetic plastic material. This makes possible a simple manufacture of a thread which is under prestress to provide a play-free, easily blocking coupling of the adjusting sleeve on the clamping sleeve.

This is especially advantageous for the efficient and reliable coupling of the adjusting sleeve with the clamping sleeve.

It is further advantageous when in accordance with the present invention the pressure spring arranged on one of the columns is supported relative to the adjusting member exactly centrally, especially on a tip or a ball. This prevents an undesired torsion of the pressure spring, which can lead to an unauthorized subsequent turning of the adjusting member.

In accordance with a further feature of the present invention, the motor housing can be fixed with elastic elements and a quick clamping disc can be used, which simplifies the mounting with the increased tolerances.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
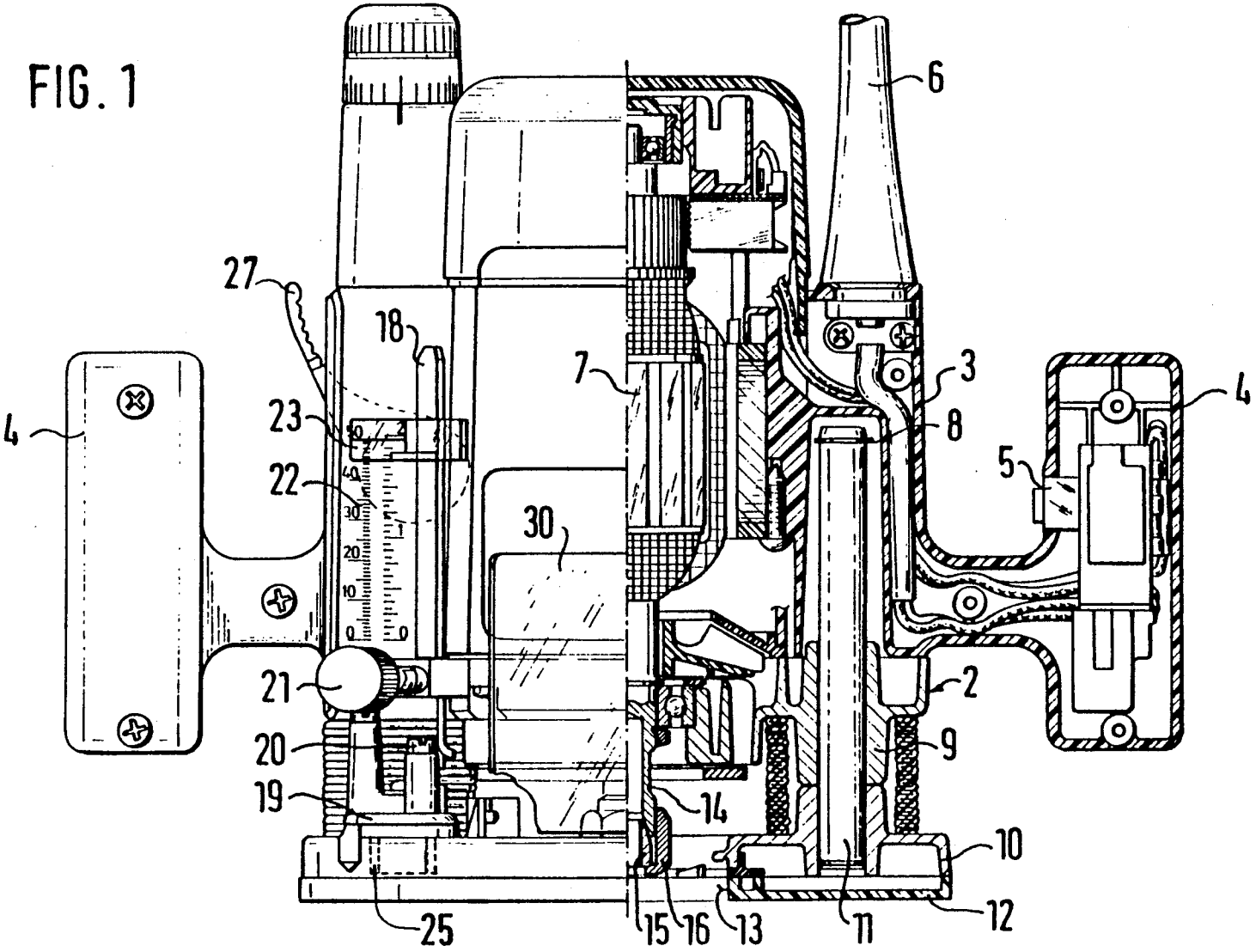
FIG. 1 is a partial sectioned plan view of a routing machine in accordance with the present invention.

A routing machine in accordance with the present invention has a two-part motor housing with a lower part 2 composed of aluminum and an upper part 3 composed of synthetic plastic material. Two handles 4 are connected with the upper part 3. An electrical switch 5 is accommodated in one of the handles. The switch is electrically connected with the network connecting conductor 6 and the drive motor 7.

Vertically oriented guiding pipes 9 are formed on the lower part 2 of the housing and directly guided on two guiding columns which extend vertically from a foot plate 10. One of the guiding columns 25 is hollow, while the other guiding column 11 is solid. A spring ring 8 is arranged in a ring groove at the upper end of the solid guiding column 11 and prevents an undesired sliding of the motor housing 2, 3 from the guiding columns 11, 25.

The foot plate 10 carries a synthetic plastic bottom 12 for protecting a workpiece to be machined. The foot plate 10 and the bottom 20 have a central opening 13, through which a motor spindle 14 extends. The spindle is provided with a clamping sleeve 15 which is clampable by a hexagonal nut 16. A rotary teller 19 is mounted on the foot plate 10 as an abutment for for a rod 18 for milling depth adjustment, by means of three adjustable screws 20. The rod 18 is fixed by an adjusting screw 21 which is inserted in a screw thread in the lower part of the motor housing. For easy adjustment of the desired milling depth, the upper part 3 of the housing has a scale 22, and a displaceable slider 23 of plexiglass provided with a marking line is mounted on the rod 18.

Figure 2:
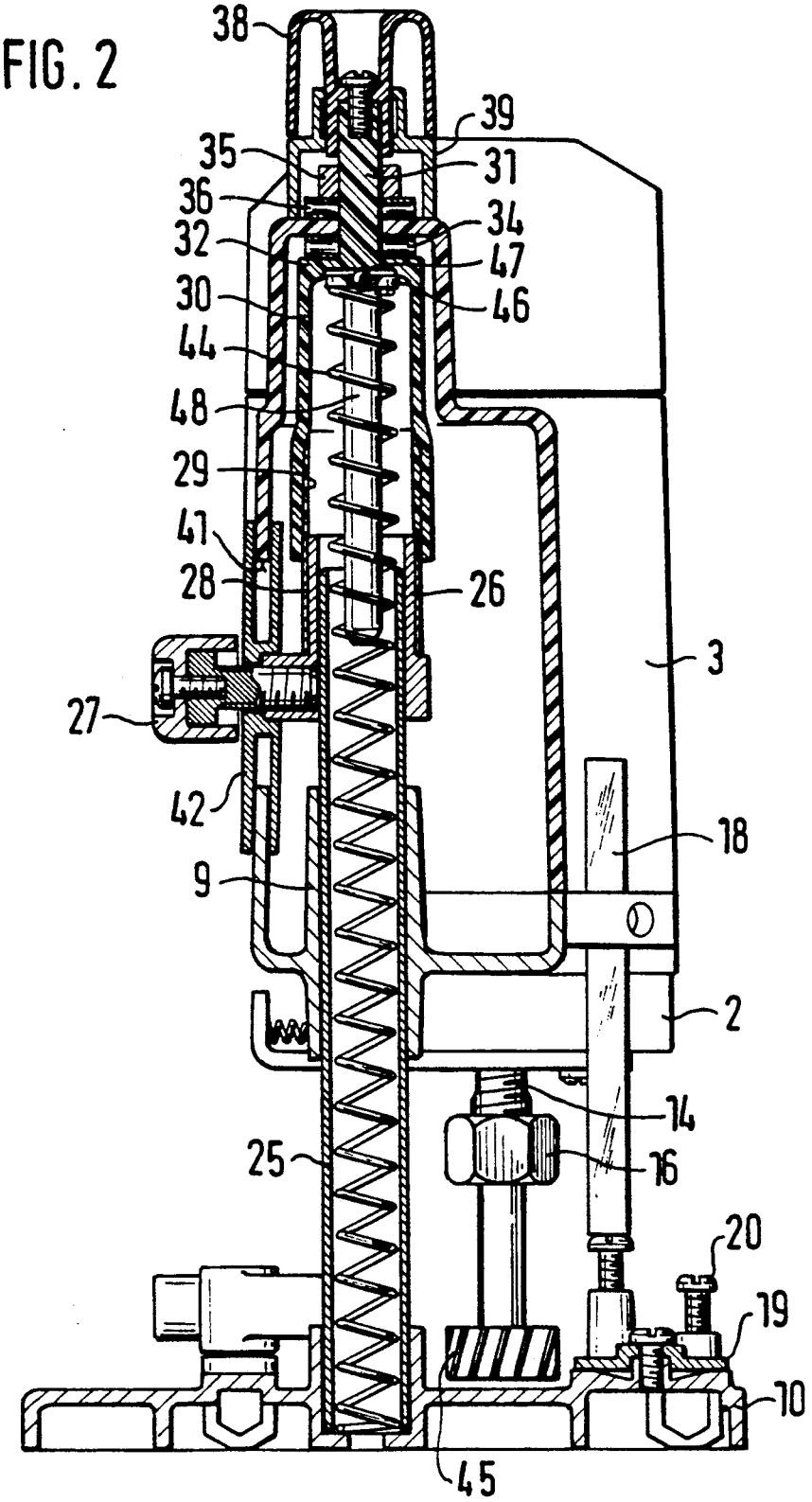
FIG. 2 is a view showing a longitudinal section of a fine adjusting device of the inventive routing machine.

The motor housing 2, 3 is fixable relative to the foot plate 10 by means of a clamping sleeve 26 with a clamping screw 27 which is movable on the main column 25, as shown in FIG. 2. The clamping screw 27 is arranged in a thread of the clamping screw 26 which extends substantially perpendicularly to the axis of the main column 25, so that it can be pressed against the main column 25. The clamping sleeve 26 has an outer thread 28 extending in its axial direction. An inner thread 29 of a stepped adjusting member 30 is screwed on the outer thread 28. The adjusting member 30 has a lower hollow cylindrical part and is composed preferably of synthetic plastic material. The inner thread 29 has a prestress relative to the outer thread 28 to eliminate a thread play. This can be achieved for example by an insignificantly greater or smaller thread pitch or by a slightly overlapping thread profile.

The upper part of the adjusting member 30 is completely cylindrical and forms a central neck 31. A shoulder 32 formed as the transition of the hollow cylindrical part to the neck 31 abuts against the upper part 3 of the housing. The axial roller bearing 34 is inserted between the shoulder 32 and the housing part 3. The housing part 3 is adjustably fixed without play relative to the adjusting member 30 by means of a nut 35 which is screwed on the nut 31 or by means of another mounting element. A further roller bearing 36 is inserted between the housing part 3 and the nut 35.

An outwardly flanged rotary knob 38 is screwed with the neck 31. A scale ring 39 is inserted between the rotary knob 38 and the upper part 3 of the housing. It is adjustable relative to the rotary knob 38 to zero provided with tenth-millimeter or 1/256 inch graduations. The upper part 3 of the housing has a slot 41 extending laterally along the main column 25 and closed by a double-bottom cover plate 42. The cover plate has an opening through which the clamping sleeve 26 extends. The cover plate 42 covers the edges of the slot 31 both from outside and inside and provides an efficient protection from dirtying of the interior part of the fine adjustment assembly.

A long spring 44 is located inside the main column 25. It abuts on one side against the foot plate 10 and on the other side against the adjusting member 30. The spring formed as a pressure spring serves for lifting the motor housing 2, 3 relative to the foot plate 10 when the clamping screw 27 is opened. The friction in the thread 28/29 insures that the milling depth cannot be undesirably adjusted during operational vibrations of the mill. The pressure spring 44 which is firmly prestressed against the foot plate 10 is not twisted due to the special, central support relative to the adjusting member 30. Therefore in the spring no torsion stresses occur which can lead to an unauthorized return rotation of the adjusting member 30. The arrangement of all important column elements with the pressure spring 44, clamping spring 26 and fine adjusting member 30 on one main column 25 has the advantage that between both columns 11 and 12 a clamping of the motor housing 2 cannot occur.

Figure 3:
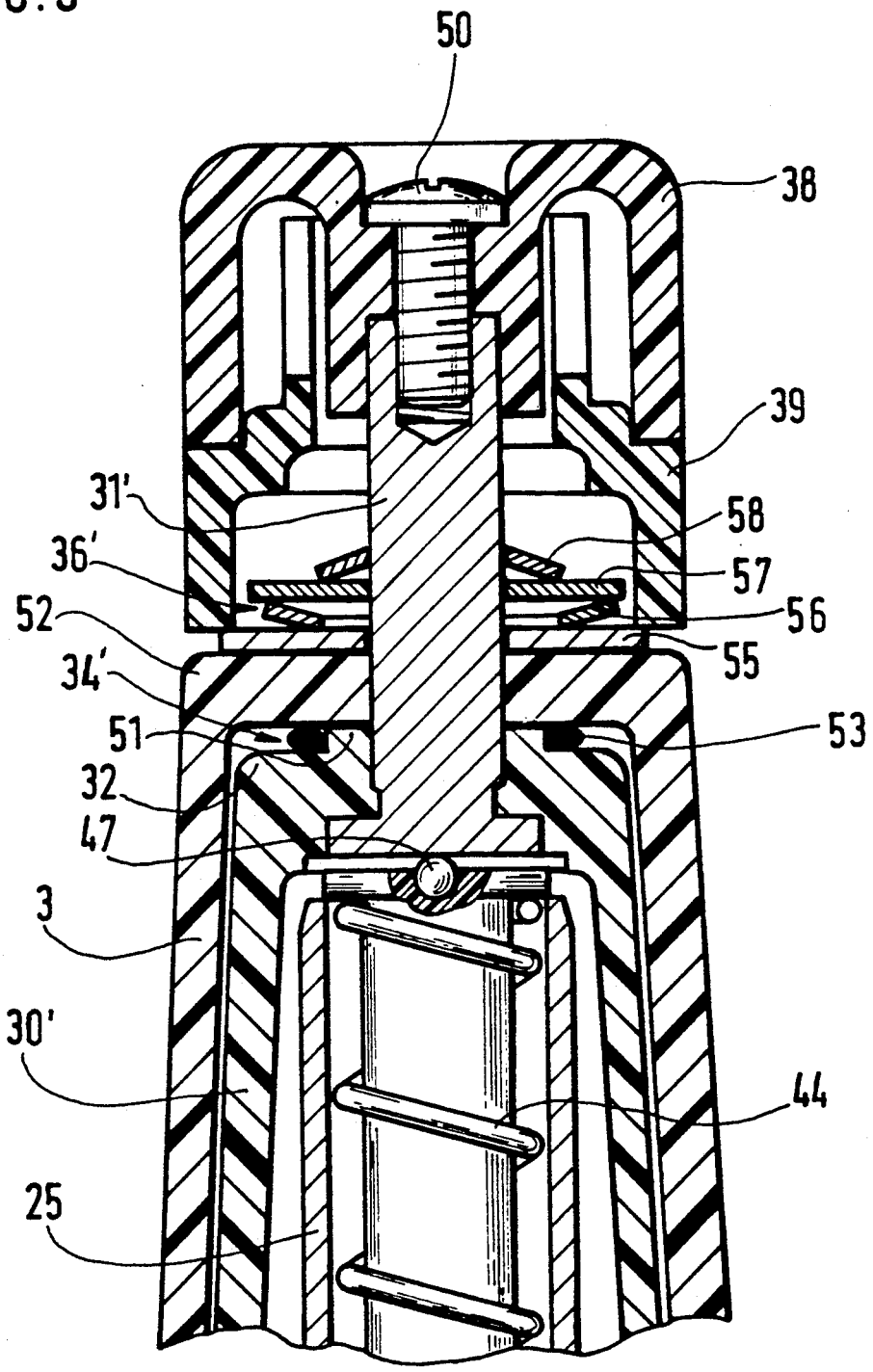
FIG. 3 is a view showing an inventive routing machine in accordance with a second embodiment of the present invention.

In a routing machine in accordance with the present invention shown in FIG. 3 only the adjusting member 30' and the region of the support of the housing part 3 on the adjusting member differs from those of the first embodiment.

The adjusting member 30' has a neck 31 formed as an ejection molded metal projection, and the ball 47' for abutment of the pressure spring 44 abuts against the projection. A screw 50 is inserted above in the neck 31' and secures the rotary knob 38. The bearings 34' and 36' are formed as sliding bearings. A disc shaped projection 51 is formed on the shoulder 32 of the adjusting member 30 and abuts against a dome 52 of the motor housing. An O-ring 53 is arranged the projection 51 and compressed in the mounting condition between the shoulder 32 and the dome 52. At one side of the ring 53, successively a first disc 55, a spring disc 56 and a second disc 57 abut against the dome 52. The discs 55 and 57 are held by a quick clamping disc 58 which is fitted on the neck 31' and is clamped in it.

By mounting of the routing machine, the quick clamping disc 58 is pressed with a predetermined force P so that the O-ring 53 is compressed, the projection 51 is brought in contact with the dome 52, and the play between the shoulder 32 and the quick clamping disc 58 is eliminated. Certain tolerances of the force P are compensated by the elastic bearing elements 53 and 56. They also serve for the damping of the rotary movement for fine adjustment, to prevent automatic displacement caused in some cases by operational vibrations of the mill. A pretensioning of the thread between the adjusting sleeve 30 and the clamping sleeve 26 is here superfluous.

The invention, of course, is not limited to the shown examples. In particular, the securing member can be formed as a nut 35, a quick clamping disc 58 or another suitable structural element. Also, the provided for the dampening and avoiding an automatic turning of the fine adjustment are exchangeable.

It will be understood that each of the elements described above, or two or more together, may also find a useful application in other types of constructions differing from the types described above.

While the invention has been illustrated and described as embodied in a routing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A routing machine, comprising a motor housing with a lower side having a tool receptacle for a milling tool; a foot plate adapted to be placed on a workpiece; guiding columns extending perpendicularly relative to said foot plate, said motor housing being arranged displaceably on said guiding columns parallel to an axis of the milling tool; a clamping sleeve having a clamping screw and releasably fixing said motor housing on at least one of said guiding columns; at least one spring supporting said motor housing on said foot plate; an adjusting member axially displaceable relative to said clamping sleeve by means of a thread and supporting the weight of said motor housing, said spring having an upper end abutting against said adjusting member; bearings formed so that said motor housing is supported on said adjusting member through said bearings, said motor housing having a slot which extends parallel to said at least one column for passing said clamping screw therethrough; and a cover plate which has a length overlapping said slot for protecting said at least one column from contamination.

2. A routing machine as defined in claim 1, wherein said motor housing is guided directly on said columns.

3. A routing machine as defined in claim 1, wherein said housing is formed as an aluminum pressure casting part with guiding pipes which are formed on said part and directly slide on said columns.

4. A routing machine as defined in claim 1, wherein said adjusting member is composed of synthetic plastic material.

5. A routing machine as defined in claim 1, wherein said adjusting member and said clamping sleeve each have a thread, said thread of the adjusting member being prestressed relative to said thread of said clamping sleeve.

6. A routing machine as defined in claim 1, wherein said spring is supported in said at least one column exactly centrally to said adjusting member.

7. A routing machine as defined in claim 6; and further comprising a disc with a central projection which centrally supports said spring in said column.

8. A routing machine as defined in claim 1, wherein said bearings are roller bearings.

9. A routing machine as defined in claim 1, wherein said bearings are sliding bearings provided with elastic bearing elements.

10. A routing machine as defined in claim 1; and further comprising a quick clamping disc for fixing said motor housing.

11. A routing machine as defined in claim 1, wherein said adjusting member, said clamping sleeve and said spring are arranged together on said at least one column to prevent canting of said motor housing.

12. A routing machine, comprising a motor housing with a lower side having a tool receptacle for a milling tool; a foot plate adapted to be placed on a workpiece; guiding columns extending perpendicularly relative to said foot plate, said motor housing being arranged displaceably on said guiding columns parallel to an axis of the milling tool; a clamping sleeve having a clamping screw and releasably fixing said motor housing on at least one of said guiding columns; at least one spring supporting said motor housing on said foot plate; an adjusting member axially displaceable relative to said clamping sleeve by means of a thread and supporting the weight of said motor housing, said spring having an upper end abutting against said adjusting member; bearings formed so that said motor housing is supported on said adjusting member through said bearings, said bearings being provided with elastic bearing elements.

13. A routing machine as defined in claim 12, wherein said motor housing has a slot which extends parallel to said at least one column for passing said clamping screw therethrough.

14. A routing machine as defined in claim 13; and further comprising a cover plate which has a length overlapping said slot for protecting said at least one column from contamination.

15. A routing machine, comprising a motor housing with a lower side having a tool receptacle for a milling tool; a foot plate adapted to be placed on a workpiece; guiding columns extending perpendicularly relative to said foot plate, said motor housing being arranged displaceably on said guiding columns parallel to an axis of the milling tool; a clamping sleeve having a clamping screw and releasably fixing said motor housing on at least one of said guiding columns; at least one spring supporting said motor housing on said foot plate; an adjusting member axially displaceable relative to said clamping sleeve by means of a thread and supporting the weight of said motor housing, said spring having an upper end abutting against said adjusting member; bearings formed so that said motor housing is supported on said adjusting member through said bearings, said motor housing having a slot which extends parallel to said at least one column for passing said clamping screw therethrough; and a cover plate which has a length overlapping said slot for protecting said at least one column from contamination, said bearings being provided with elastic bearing elements.

* * * * *